US010601165B2

(12) United States Patent
Gabet et al.

(10) Patent No.: US 10,601,165 B2
(45) Date of Patent: Mar. 24, 2020

(54) ANGLED MULTI-CONTACT CONNECTOR AND ASSEMBLY METHOD THEREOF

(71) Applicant: RAYDIALL, Voiron (FR)

(72) Inventors: Denis Gabet, Voreppe (FR); Sebastien Annequin, Saint Nicolas de Macherin (FR)

(73) Assignee: RAYDIALL, Voiron (FR)

( * ) Notice: Subject to any disclaimer, the term of this patent is extended or adjusted under 35 U.S.C. 154(b) by 0 days.

(21) Appl. No.: 15/413,784

(22) Filed: Jan. 24, 2017

(65) Prior Publication Data

US 2017/0214171 A1 Jul. 27, 2017

(30) Foreign Application Priority Data

Jan. 25, 2016 (FR) ..... 16 50574

(51) Int. Cl.
*H01R 13/502* (2006.01)
*H01R 43/20* (2006.01)
(Continued)

(52) U.S. Cl.
CPC ..... *H01R 13/502* (2013.01); *H01R 4/18* (2013.01); *H01R 13/4361* (2013.01);
(Continued)

(58) Field of Classification Search
CPC ..... H01R 12/77; H01R 12/772; H01R 13/53; H01R 13/58; H01R 13/60; H01R 13/582;
(Continued)

(56) References Cited

U.S. PATENT DOCUMENTS

| | | | | |
|---|---|---|---|---|
| 5,894,661 | A | 4/1999 | Wada et al. | |
| 6,071,153 | A | 6/2000 | Fink et al. | |
| 8,801,456 | B2 * | 8/2014 | Miyakawa | H01R 13/111 439/466 |
| 9,362,656 | B2 * | 6/2016 | Singhammer | H01R 13/502 |
| 2005/0181664 | A1 | 8/2005 | Fukuzaki et al. | |
| 2013/0143424 | A1 | 6/2013 | Nguyen Nhu et al. | |
| 2013/0164996 | A1 * | 6/2013 | Miyakawa | H01R 13/111 439/694 |

(Continued)

FOREIGN PATENT DOCUMENTS

| | | |
|---|---|---|
| DE | 696 15 432 T2 | 5/2002 |
| DE | 10 2010 039 314 A1 | 2/2012 |

(Continued)

OTHER PUBLICATIONS

French Search Report for corresponding French Application No. FR 16 50574, dated Dec. 20, 2016.

*Primary Examiner* — Hae Moon Hyeon
(74) *Attorney, Agent, or Firm* — Jones Robb, PLLC

(57) ABSTRACT

An angled multicontact connector comprises at least two angled contacts, an insulative angled body made of an insulative material, a conductive angled body made of a conductive material, a conductive material cap adapted to be fixed to the cable and to close the conductive angled body around the angled contacts. The insulative angled body includes at least one groove open toward the outside, each groove being adapted to receive at least in part the rear end of one of the angled contacts. The angled multicontact connector further includes an insulative material part adapted to be removably fixed to the insulative angled body to retain the rear end of the angled contacts not received in a groove and to separate each rear end from the rear end of any other angled contact, and from the conductive cap when the conductive cap is in a position closing the conductive angled body.

13 Claims, 9 Drawing Sheets

(51) Int. Cl.

| | |
|---|---|
| ***H01R 13/436*** | (2006.01) |
| ***H01R 4/18*** | (2006.01) |
| ***H01R 24/28*** | (2011.01) |
| *H01R 13/506* | (2006.01) |
| *H01R 9/03* | (2006.01) |

(52) U.S. Cl.
CPC ..... *H01R 24/28* (2013.01); *H01R 43/20* (2013.01); *H01R 9/03* (2013.01); *H01R 13/506* (2013.01)

(58) Field of Classification Search
CPC .. H01R 13/5845; H01R 23/661; H01R 31/06; H01R 43/20
USPC ..... 439/449
See application file for complete search history.

(56) References Cited

U.S. PATENT DOCUMENTS

| | | | | |
|---|---|---|---|---|
| 2014/0007427 | A1 | 1/2014 | Petermann et al. | |
| 2015/0147918 | A1* | 5/2015 | Matsuda ..... | H01R 13/5841 439/694 |
| 2015/0303606 | A1* | 10/2015 | Singhammer ..... | H01R 13/502 439/136 |

FOREIGN PATENT DOCUMENTS

| | | | |
|---|---|---|---|
| EP | 1 825 575 | B1 | 8/2007 |
| EP | 2 603 953 | B1 | 6/2013 |
| EP | 2 654 141 | A1 | 10/2013 |
| EP | 2 915 218 | B1 | 9/2015 |
| WO | 2015/094120 | A1 | 6/2015 |

* cited by examiner

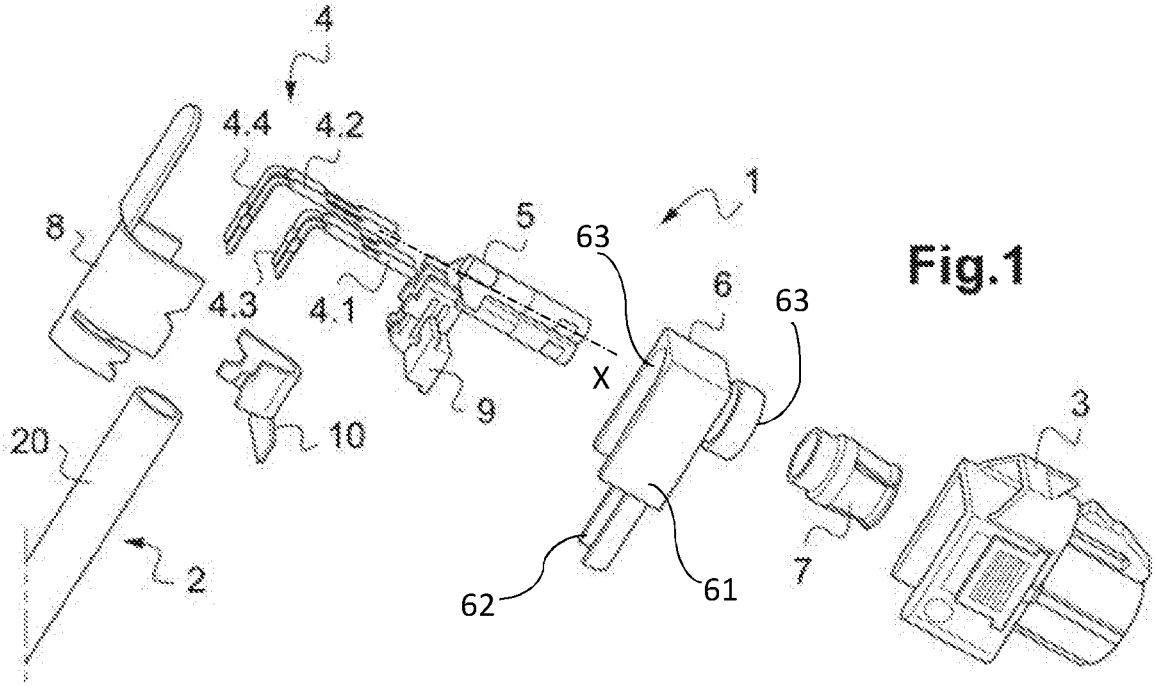
Fig.1
Fig.2
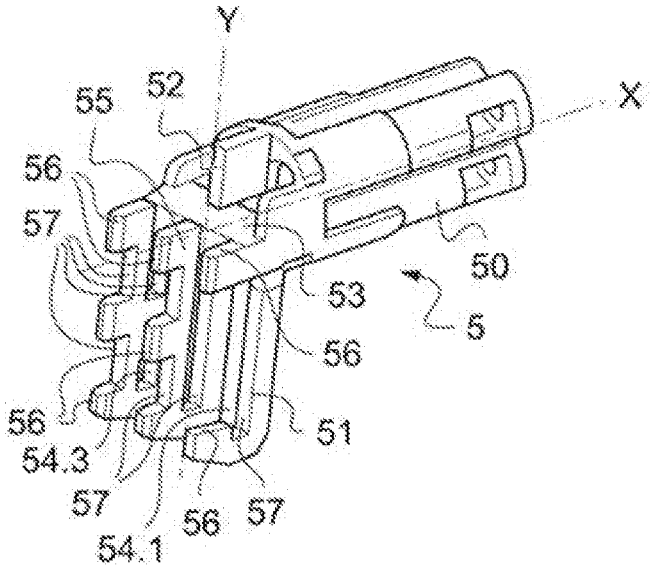
Fig.2A
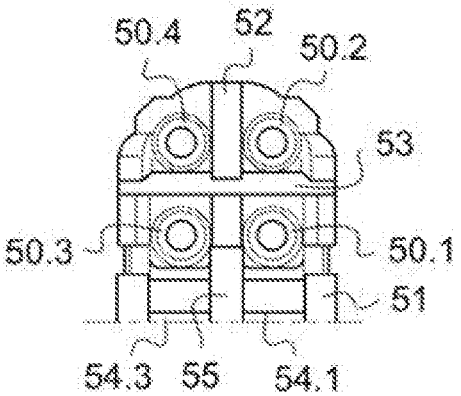

Fig.3
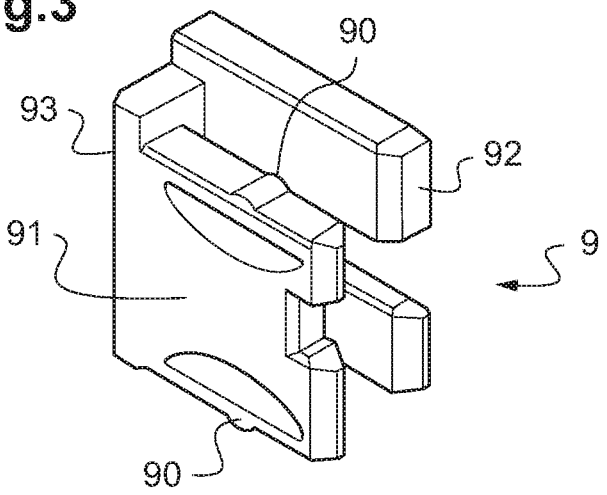
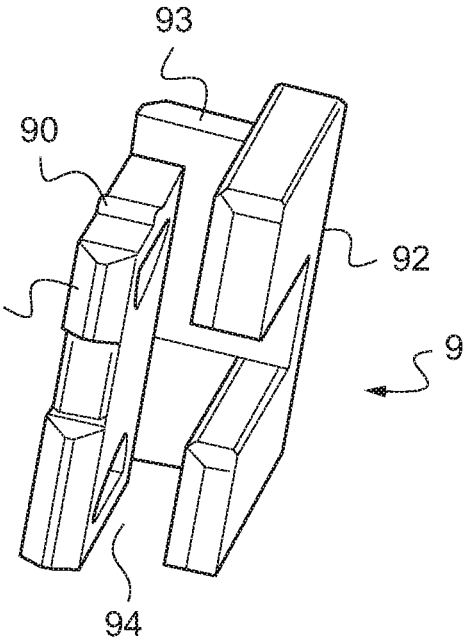
Fig.3A
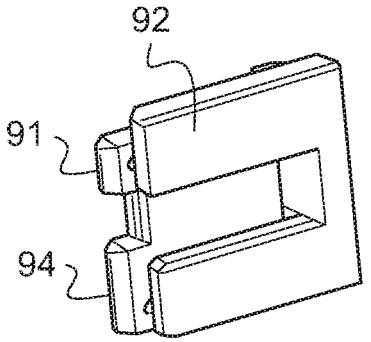
Fig.3B

Fig.4D
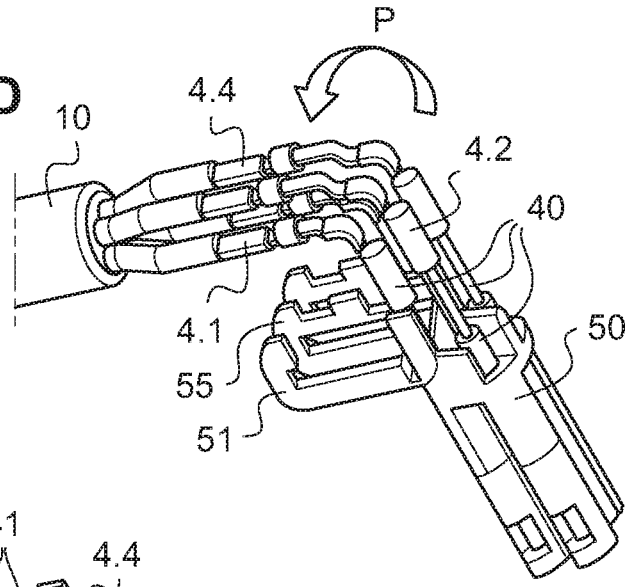
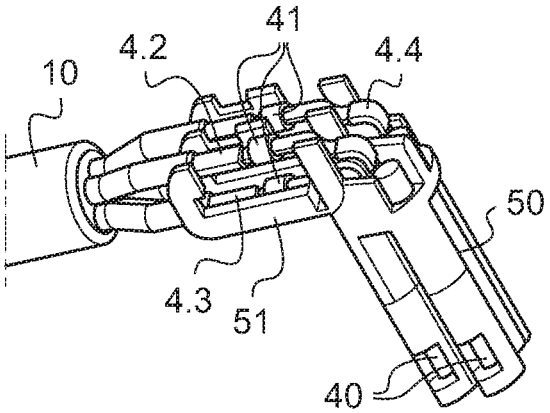
Fig.4E
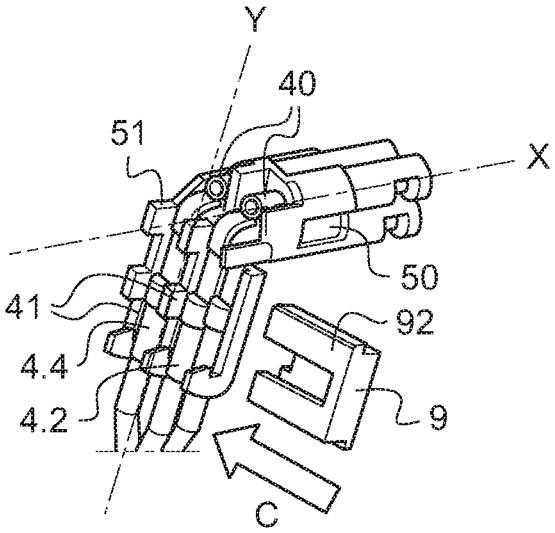
Fig.4F
Fig.4G
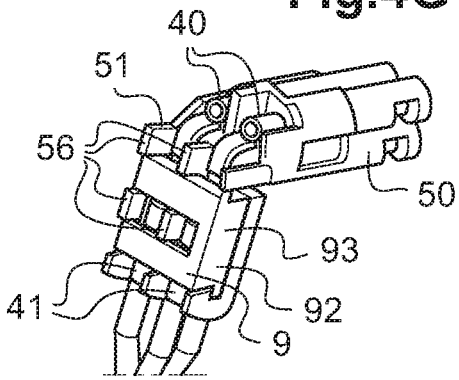

Fig.4H
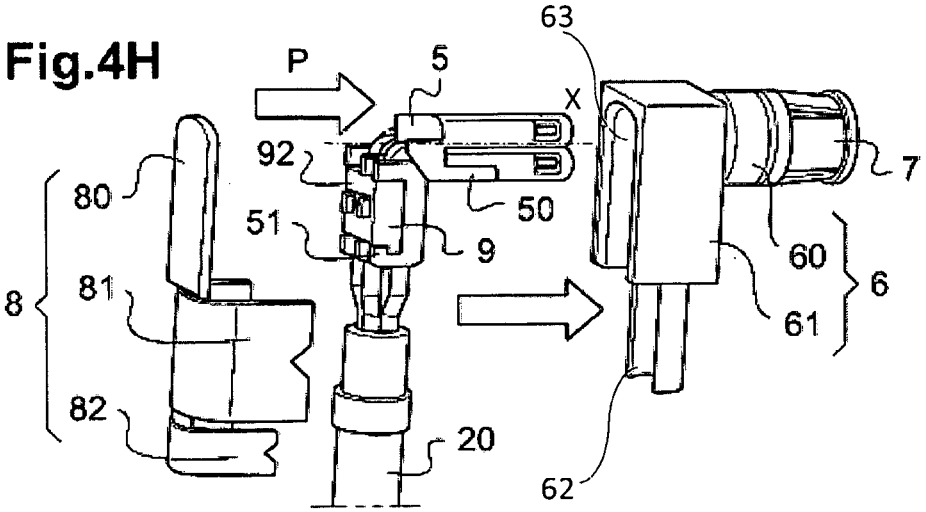
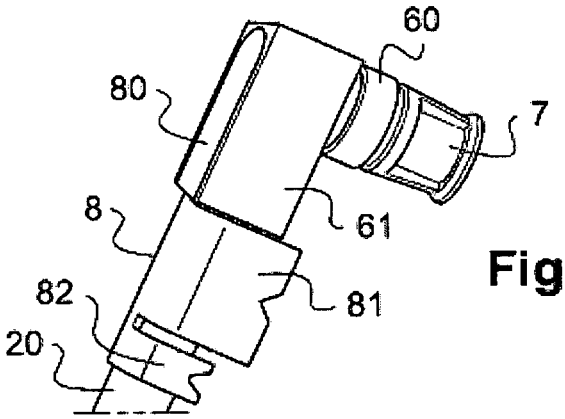
Fig.4I
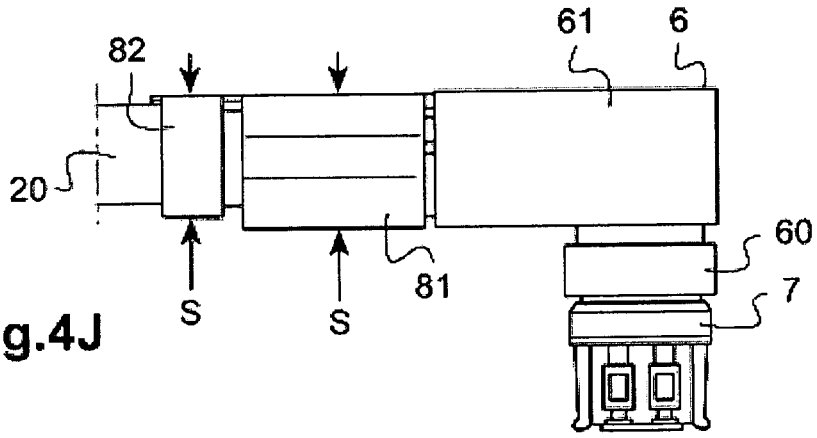
Fig.4J

Fig.4K
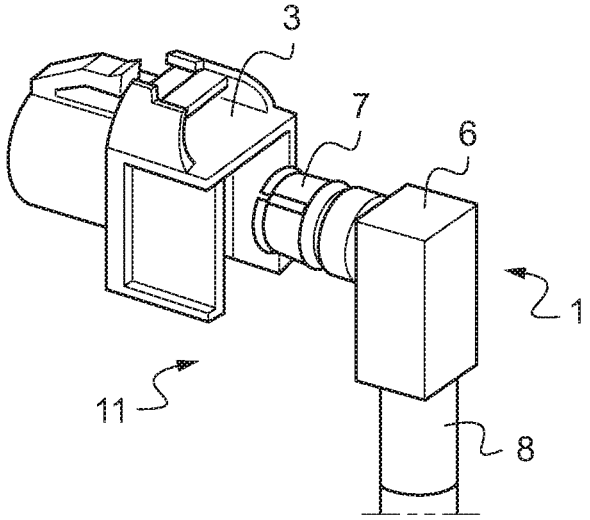
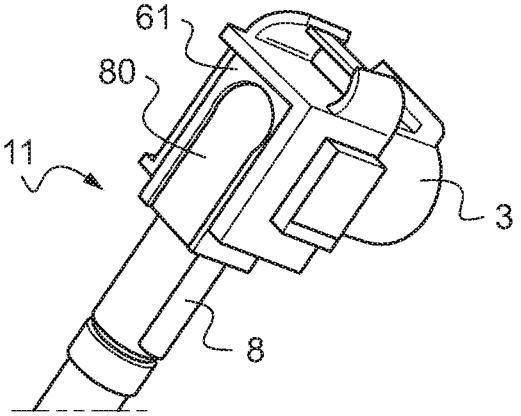
Fig.4L
Fig.5
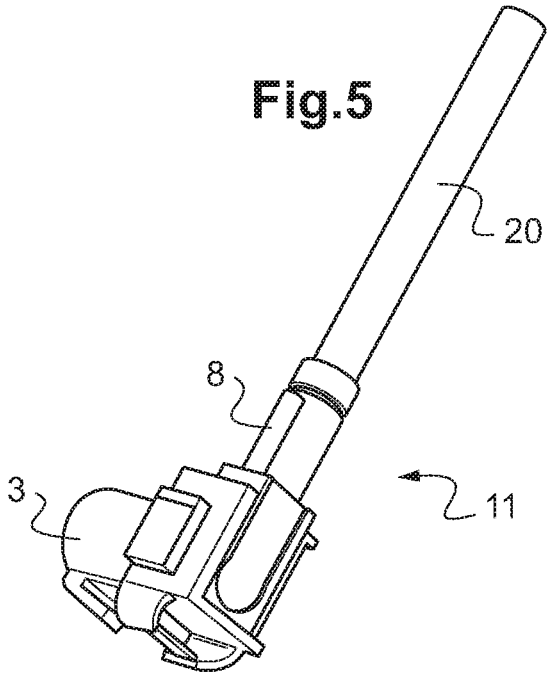

ANGLED MULTI-CONTACT CONNECTOR AND ASSEMBLY METHOD THEREOF

INTRODUCTION

The present invention concerns an angled electrical connector of the multicontact type intended to be mounted on a cable including a plurality of insulated conductors, a connection system including a connector of this kind, and an associated assembly method.

The connector according to the invention is advantageously an RF connector, i.e. able to transmit signals in the range from direct current (DC) to radiofrequencies (RF), including microwave frequencies (HF), the signals being high speed data link (HSDL) digital signals or RF signals.

The invention more particularly concerns angled multicontact connectors intended to be mounted on cables with insulated conductors of differential pair type comprising four conductors or more per differential pair.

The patent EP 1825575B1 discloses an angled multicontact connector including an electrical insulator in which each of four central contacts is mounted by clipping it into a groove in the body, clipping being effected via the lateral side of the groove open to the outside over all its length. This clipping solution is unsatisfactory because in the event of incorrect clipping of one or other of the contacts a short circuit may occur with the shielding conductive body arranged around the insulator.

To prevent this short circuit problem, the patent application EP 2915218A1 proposes to add tongues of material incorporated in the insulator that are bent over the grooves once the contacts have been clipped inside them. A disadvantage of this solution is that it is not easy for an operative assembling the connector to hold the tongues simultaneously in their bent over position for the time it takes to fit the shielding conductive body around them.

The patent application EP 2603953A1 proposes an analogous solution with parts that are folded over but these are mounted directly on the insulator on hinges and are folded over to trap the contacts, in order to immobilize them but also to insulate them from one another, the front portions of the contacts being first inserted longitudinally via the rear end of the body into through-openings forming housings. This solution implies a non-negligible additional cost linked to the production of the hinges, which may moreover be relatively fragile.

The solutions disclosed by the applications EP 2915218A1 and EP 2603953A1 moreover imply a necessarily limited choice of insulating material for the production of the tongues that can be bent over or hinged parts that can be folded over and a non-negligible production cost.

Overview

There exists a need to remedy some or all of the above drawbacks.

The invention aims to address this need and does so, in one of its aspects, thanks to an angled multicontact connector for a cable including a plurality of insulated conductors, including:

- at least two angled contacts each adapted to be fixed, preferably by crimping, by its rear end to an end of a conductor of the cable,
- an insulative material angled insulator including:
  - a front portion extending along a first axis of the insulator including at least two through-openings, each through-opening being adapted to accommodate a front end of a contact, the front portion including at least one wall between through-openings adapted to separate the contacts from one another;
  - a rear portion extending along a second axis of the body;
- a conductive material angled body including a front portion extending along a first axis of the body and including a through-opening adapted to accommodate the front portion of the insulator and a rear portion extending along a second axis of the body and including a groove adapted to receive the rear portion of the insulator;
- a conductive material cap of complementary shape to the rear portion of the body adapted to be fixed to the cable and to close the conductive body around the contacts.

The connector according to the invention is characterized in that the front portion of the insulator includes at least one groove open toward the inside of the insulative body, the groove being adapted to receive at least in part a rear end of a contact and in that it further includes an insulative material part adapted to be removably fixed to the insulative body, the part including walls adapted to retain each rear end of a contact not received in the bottom of a groove in the insulator and to separate it on the one hand from each rear end of another contact received or not in the bottom of a groove in the insulator and on the other hand the conductive cap in its position closing the conductive body.

According to one advantageous embodiment, the rear portion of the insulator is configured so that the insulating part is inserted in it in a direction transverse to the second axis of the body, the insulating part including means for clipping it onto the rear portion once the transverse insertion has been effected.

In other words, the invention essentially consists in configuring the insulator to allow mounting of the contacts by insertion from the rear and to allow the removable fixing of a single insulating part the function of which is both to retain, i.e. to immobilize, the contacts transversely to the axis of the rear portion of the insulator, to insulate the contacts from one another, and also to insulate the contacts that are nearest the outside of the bend in the connector, i.e. the longest contacts, from the conductive cap that with the conductive body forms a shielding assembly.

The insulating part according to the invention has numerous advantages compared to the prior art solutions and notably the tongues that may be bent according to EP2915218A1 or the hinged parts that may be folded over according to EP2603953A1, including the following:

- no specific constraint on the choice of the material constituting the insulating part;
- the cost of producing this insulating part, the shape of which may be simple, may be low;

the mounting of this insulating part is reliable and easy; the association of the angled and grooved insulator with the insulating part allows insulation of each contact from another and insulation between conductive cap and body and the contacts. According to one advantageous embodiment of the invention, the rear portion of the insulator is configured so that the insulating part is inserted in it in a direction transverse to the second axis (Y) of the body, the insulating part including means for clipping it onto the rear portion once the transverse insertion has been effected.

According to a first variant, the insulating part is generally U-shaped, one branch of the U-shape being adapted to separate each rear end of the contact or contacts received in the bottom of a groove in the rear portion of the insulator and that of the superposed contact or contacts not received in the bottom of the groove, the other branch of the U-shape being adapted to separate the conductive cap and each rear end of the contact or contacts not received in the bottom of the groove while the bottom of the U-shape defines the mounting clearance of each rear end of the contact or contacts not received in the bottom of the groove.

According to another variant, the insulating part has the general shape of multiple U-shapes, one of the outer branches and the inner branch or branches of the multiple U-shape being adapted to separate each rear end of the contact or contacts received in the bottom of a groove in the rear portion of the insulator and that of the superposed contact or contacts not received in the bottom of the groove, the other outer branch of the multiple U-shape being adapted to separate the conductive cap and each rear end of the contact or contacts not received in the bottom of the groove, while the bottom of the multiple U-shape defines the mounting clearance of each rear end of the contact or contacts not received in the bottom of the groove.

The insulating part preferably includes at least one key to prevent mounting it the wrong way round.

According to one advantageous embodiment, the insulating part further includes a wall with substantially the same angled shape as the insulator and the angled contacts, the bend in the insulating part being adapted to cover the space above the contacts nearest the outside of the bend in the insulator to form an abutment in respect of movement in translation of said contacts in the direction of the first axis of the insulating body. The abutment defined in this way makes it possible to minimize the backward movement of the front ends of the exterior contacts when connecting the connector to a complementary connector. Thus no significant deformation of the angle of the contacts may occur.

The connector advantageously includes a conductive element closed on itself adapted to be fixed to the inside of the front portion of the conductive body so as to form an earth contact.

According to a variant embodiment, the connector includes at least four angled contacts, the front portion of the insulator including at least one wall for separating the two contacts accommodated in the openings on the inside of the bend from those accommodated in the openings on the outside of the bend or in openings in intermediate positions of the bend, the front portion and/or the rear portion of the insulator including at least one wall for separating the two contacts accommodated in the openings on one side of the first axis (X) of the insulator from those accommodated in the openings on the other side or in intermediate openings.

The conductive cap that closes the body is advantageously made of metal. The configuration of the body and the cap enables high-frequency leakage to be limited and strengthens the mechanical retention of the insulator of the connector in the body.

The body and the cap may be two separate parts, preferably made of metal, connected or not by a pivoting hinge.

In another aspect the invention concerns a connection system including:

an angled multicontact connector as described above;

an electrically insulative housing adapted to be mounted around the front portion of the angled insulator.

The invention also consists in a method of assembling part of an angled multicontact connector, including the following steps:

a/ procuring a cable including a plurality of insulated conductors;

b/ procuring a part of an angled connector adapted to be mounted on said cable, the part of the connector including:

at least two contacts, an insulative material angled insulator including:

a front portion extending along a first axis of the insulator including at least two through-openings, each through-opening being adapted to accommodate the front end of a contact, the front portion including at least one wall between through-openings adapted to separate the contacts from one another;

a rear portion extending along a second axis of the insulator and including at least one groove open toward the outside of the insulator, the groove being adapted to receive at least in part the rear end of a contact;

c/ fixing the conductors of the cable to the contacts of the connector;

d/ inserting parallel to the first axis of the insulator the front ends of the contacts in the though-openings of the front portion of the angled insulator;

e/ bending the contacts;

f/ accommodating the rear ends of the contacts situated on the inside of the bend in the grooves in the front portion of the insulator;

g/ clipping an insulating material part in the rear portion of the insulator, the part including walls adapted to retain each rear end of a contact not received in a groove in the insulator and to separate it on the one hand from each rear end of another contact received in a groove in the insulator and on the other hand from the outside of the insulator;

the step c/ being carried out either before the step d/ or after the step f/;

the step e/ being carried out either before the step d/ or after the step d/.

In a first variant of the step c/ of the method, the contacts may be crimped onto the conductors of the cable. In this first variant, this step c/ may take place before the step d/ of partial insertion of the contacts in the insulator and the bending step e/.

In a second variant of the step c/, the contacts may be soldered to the conductors of the cable. In this second variant, this step c/ may take place before the step d/ of partial insertion of the contacts in the insulator and the bending step e/ or after the step f/ if the contacts are accommodated in the rear part of the insulator.

The contacts may be bent before or after their partial insertion into the front portion of the insulator. This variant may be applied to contacts already soldered or crimped to the conductors of the cable. The method may advantageously include a step of crimping the cap onto the rear portion of the conductive body.

It may also include an advantageous step of crimping the cap to a shielding braid and/or an inner and/or outer insulative sheath of the cable.

The method according to the invention may be particularly simple and quick to use because the contacts are mounted from the rear by accommodating their front end in the openings passing through the insulator and the single part providing the physical separation between contacts and from the outside and therefore the shielding conductive cap is fitted by inserting it in and clipping in the insulator.

BRIEF DESCRIPTION OF DRAWINGS

The invention will be better understood on reading the following description of nonlimiting embodiments thereof and examining the appended drawings, in which:

FIG. 1 is an exploded view of a connection system with an angled multicontact connector according to the invention, FIGS. 2 and 2A are views respectively in perspective and along one of the axes of the angled insulator of an angled multicontact connector according to one embodiment of the invention, FIGS. 3, 3A and 3B are perspective views from different angles of the insulating part according to the invention fixed to the angled insulator from FIGS. 2 and 2A, FIGS. 4A to 4L show an example of the sequencing of the various steps of assembling a connection system incorporating an angled multicontact connector according to the invention, FIG. 5 is a perspective view of the connection system when assembled by the method shown in FIGS. 4A to 4L.

DETAILED DESCRIPTION OF A VARIOUS EMBODIMENTS

Figure 4A:
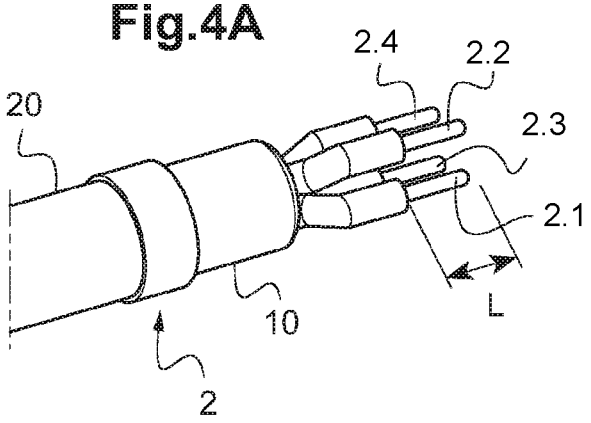

There has been represented in FIG. 1 a connection system incorporating an angled multicontact connector 1 according to one embodiment of the invention.

In the example described, this system includes the angled connector 1 according to the invention and a plastic material housing 3 on which it is mounted.

As shown, the angled connector 1 according to the invention includes an assembly 4 including four contacts 4.1, 4.2, 4.3, 4.4, an angled insulator 5 accommodating the contacts, an insulating part 9 inserted in and clipped into the angled insulator 5, a conductive body 6 accommodating the angled insulator 5 and the insulating part 9, an earth contact 7 closed on itself fixed to the conductive body 6, and a conductive material cap 8 adapted to close the conductive body 6.

The angled insulator 5 may also be described as an insulative angled body.

As described hereinafter, each of the contacts 4.1 to 4.4 of the angled connector 1 is crimped to a conductor 2.1 to 2.4 of a cable 2 with a plurality of insulated conductors further including an outer sheath 20 and a crimping clip 10 at the free end of the sheath 20.

In the example described, each contact 4.1 to 4.4 is angled and made in one piece from metal using the so-called "cut-rolled" technology.

Each contact 4.1 to 4.4 includes at its front end 40 a contact portion intended to cooperate with a complementary contact portion and at its rear end 41 a crimping portion including a U-section or V-section crimping portion with two facing branches that may be bent toward one another around an insulated conductor of the cable, as described hereinafter.

The contacts are longer or shorter as a function of their position in the angled connector 1 and therefore of their position relative to the bend in the connector. Accordingly, as shown, the contacts 4.1, 4.3 on the inside of the bend are relatively shorter than the contacts 4.2, 4.4 on the outside of the bend.

There has been represented in FIGS. 2 and 2A an embodiment of the angled insulator 5 that serves as a support for the contacts 4.1 to 4.4. In the example shown, the angled insulator 5 is made in one piece.

The angled insulator 5 includes a front portion 50 extending along a first axis X and a rear portion 51 that extends along a second axis Y. In the example described, the axes X and Y are perpendicular but the invention may be applied to any non-parallel disposition of the axes X and Y. Also in the example shown, the front portion 50 is globally cylindrical but the invention applies to any other geometrical section.

The front portion 50 includes through-openings of which there are four 50.1, 50.2, 50.3, 50.4 in the example shown. Each of the through-openings 50.1 to 50.4 is adapted to accommodate the front end 40 of a contact 4.1 to 4.4. The relative arrangement, in a square in the example shown, between the openings 50.1 to 50.4 guarantees a good mutual spacing between the contacts 4.1 to 4.4.

The front portion 50 further includes:

- a wall 52 that extends between through-openings in the plane X-Y and is adapted to separate the contacts two-by-two, and
- a wall 53 that extends between through-openings in a plane perpendicular to the plane X-Y and is adapted to separate the short contacts 4.1, 4.3 from the long contacts 4.2, 4.4 at their front end.

For its part the rear portion 51 of the angled insulator 5 includes two grooves 54.1, 54.3 each open toward the outside of the insulator and separated from one another by a wall 55. Each groove 54.1, 54.3 is adapted to receive at least in part the rear end 41 of a respective contact 4.1, 4.3.

According to the invention, the rear portion 51 of the angled insulator 5 is configured so that the insulating part 9 is inserted therein in a direction transverse to the axis Y of the angled insulator 5. Thus in the example shown the rear portion 51 includes a zone defined by notches 57 and slots, notably on the wall 55, that serves as an insertion and bearing zone of the insulating part 9. The rear portion 51 finally includes a zone defined by the tops 56 on either side of the notches 57 at the top, which serves as a bearing zone of the conductive cap 8.

An embodiment of the insulating part 9 adapted to be inserted and then clipped into the rear portion 51 of the angled insulator 5 is described next with reference to FIGS. 3, 3A and 3B.

In this example shown, the insulating part 9 is generally U-shaped. One branch 91 of the U-shape has the function of separating each rear end 41 of the short contacts 4.1, 4.3 accommodated in the grooves 54.1, 54.3 from that of the long contacts 4.2, 4.4 not received in the groove. The other branch 92 of the U-shape has the function of separating each rear end 41 of the long contacts 4.2, 4.4 not accommodated in the groove 54.1, 54.3 from the conductive cap 8. A bottom 93 of the U-shape, to be more precise the space delimited between the two parallel branches 91, 92, defines the assembly clearance of each rear end 41 of the long contacts 4.2, 4.4 not received in the groove 54.1, 54.3. The bottom 93 and the branch 92 complete the insulation of the contacts relative to the conductive body 6 and the conductive cap 8.

The insulating part 9 including means 90 for clipping it onto the rear portion 51 of the angled insulator 5, once it has been inserted transversely.

As seen better in FIG. 4H, the conductive body 6 includes a front portion 60 extending along a first axis and a rear portion 61 extending along a second axis. In the example shown, the first and second axes are perpendicular but any other disposition is possible in relation to the angle between the axes X and Y of the insulator. The conductive body 6 may be made in one piece.

The front portion 60 of the conductive body 6 includes a through-opening 63 to accommodate the front portion 50 of the angled insulator 5 and the rear portion 61 includes a groove 62 adapted to receive the rear portion 51 of the angled insulator 5.

The front portion 60, of cylindrical shape in the example shown, is conformed internally to fix the earth contact 7 with its elastic tongues.

As seen better in FIGS. 1 and 4H, the conductive cap 8 of the connector includes a tongue 80 adapted to close onto the rear portion 61 of the conductive body 6 and produce the shielding part of the angled connector 1 according to the invention.

The cap 8 includes a crimping portion 81 for crimping the cap 8 around the rear portion 61 of the conductive body 6. It also includes a crimping portion 82 for crimping the cap around the insulative outer sheath 20 of the cable 2. The cap 8 may be made in one piece using the so-called "cut-rolled" technology. The cap 8 is made of metal.

The housing 3 is made of polymer, for example, and is hollow, including a through-passage.

For example, the housing 3 includes in the wall of the through-passage elastic fingers that are not shown making it possible to provide a function of locking onto the front portion 60 of the conductive body 6 and therefore of the angled connector 1 with the housing 3.

The housing 3 further includes means that are not shown for locking the connection system 11 according to the invention to a housing of a complementary connection system.

All of the steps of assembling a connection system 11 will now be described with reference to FIGS. 4A to 4L, including the assembly of the angled connector 1 according to the invention.

There is first procured a cable 2 with a plurality of insulated conductors 2.1, 2.2, 2.3, 2.4, of which there are four in the example shown, with an outer sheath 20 around which the clip 10 is crimped. The free end of each of the conductors 2.1 to 2.4 is stripped over a length L sufficient to enable a contact 4.1 to 4.4 to be crimped firmly around it (FIG. 4A).

Figure 4B:
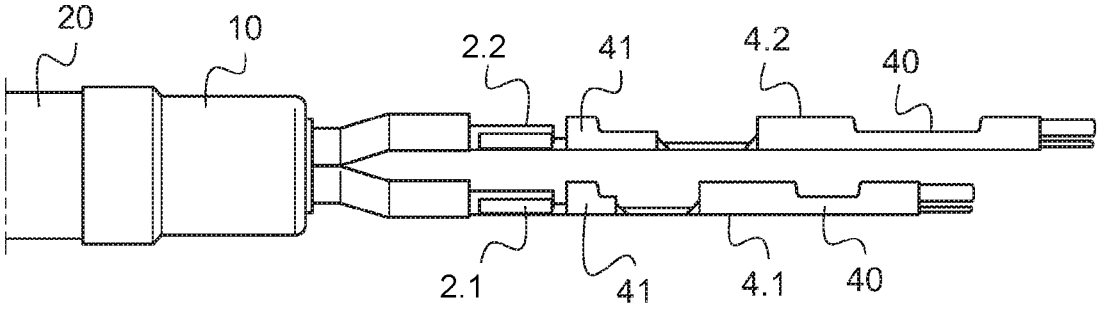

The rear end 41 of each straight contact 4.1, 4.2, 4.3, 4.4, of which there are four in the example shown, is then crimped onto a conductor 2.1 to 2.4. To be more precise, the short contacts 4.1, 4.3 are crimped onto the bottom conductors 2.1, 2.3 and the long contacts 4.2, 4.4 are crimped onto the top conductors 2.2, 2.4 (FIG. 4B).

Figure 4C:
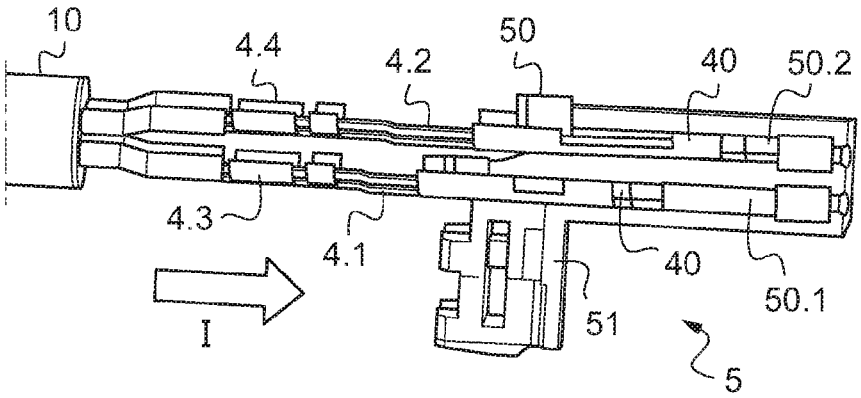

Once the contacts 4.1 to 4.4 have been crimped, their front end 40 is partly inserted into each of the through-openings 50.1 to 50.4 provided for this purpose (FIG. 4C, insertion direction as per arrow I).

The contacts 4.1 to 4.4 the front end 40 of which is accommodated in the through-openings 50.1 to 50.4 of the front portion 50 of the angled insulator 5 are then bent, at 90° in the example shown (FIG. 4D).

The contacts 4.1 to 4.4 are then pushed into the angled insulator 5 until they are in position in the latter, i.e. with the front ends 40 of the contacts 4.1 to 4.4 completely accommodated in the front portion 50 of the angled insulator 5, the rear ends 41 of the short contacts 4.1, 4.3 accommodated in their respective groove 54.1, 54.3 and the superposed long contacts 4.2, 4.4 (FIG. 4E). As may be seen in this FIG. 4E, the bending of the contacts 4.1 to 4.4 and the superposition of the long contacts 4.2, 4.4 on the short contacts 4.1, 4.4 are carried out so that a free space remains between the short contacts 4.1, 4.3 and the long ones 4.2, 4.4 once positioned in the angled insulator 5 with their bend butted up.

In this FIG. 4E, note that the grooves 54.1, 54.3 and the wall 55 separating them are of sufficient length to the rear of the rear portion 51 to guarantee complete insulation of the long contacts 4.2, 4.4 from one another.

The insulating part 9 is then clipped into the rear portion 51 of the angled insulator 5 by previous insertion transversely to its axis Y (FIG. 4F, insertion direction as per the arrow C). During clipping, the branch 91 of the part 9 is inserted into the gap between the short contacts 4.1, 4.3 and the long contacts 4.2, 4.4.

When the means 90 are clipped around the central wall of the rear portion 51, all the contacts 4.1 to 4.4 retained by the insulating part 9 are insulated from one another and the long contacts 4.2, 4.4 are insulated from the outside (FIG. 4G). To be more precise, in the example shown, in this clipped position of the insulating part 9, the branch 91 of the U-shape formed by the insulating part 9 separates each rear end 41 of the short contacts 4.1, 4.3 accommodated in the grooves 54.1, 54.3 from that of the long contacts 4.2, 4.4 not received in the groove. The branch 92 of the U-shape separates each rear end 41 of the long contacts 4.2, 4.4 not accommodated in the groove 54.1, 54.3 facing the outside. A gap 94 delimited by the bottom 93 between the two branches 91, 92 defines the mounting clearance of each rear end 41 of the long contacts 4.2, 4.4 not received in the grooves 54.1, 54.3.

At this stage, the angled multicontact connector 1 according to the invention is assembled with the contacts 4.1 to 4.4 crimped to the insulated conductors 2.1 to 2.4 of the cable 2, which are retained in the angled insulator 5 by their insertion in the front portion 50 and the locking of the angled insulator 5 in the rear portion by the insulating part 9.

The following steps are then carried out to finalise the assembly of a complete connection system 11 incorporating the angled connector according to the invention.

The front portion 50 of the angled insulator 5 is introduced into the front portion 60 of an angled conductive body 6 (FIG. 4H, the angled insulator 5 being pushed in the direction of the arrow P).

The conductive cap 8 is then closed over the rear portion 61 of the conductive body 6 in order to retain inside the body the connector part including the contacts 4.1 to 4.4 crimped to the conductors 2.1 to 2.4 of the cable 2 (FIG. 4I).

The cap 8 is then crimped to the rear portion 61 of the conductive body 6 by means of the crimping portion 81 and to the insulative outer sheath 20 of the cable 2 by means of the crimping portion 82 (FIG. 4J, crimping symbolised by the arrow S).

Once the cap 8 has been crimped, an angled connector 1 is obtained that is shielded at its periphery.

To finalise the assembly of the connection system, the conductive body 6 with the cable 2 is pre-inserted in the housing 3 (FIG. 4K), followed by complete insertion that brings about the clipping of the front portion 60 of the conductive body 6 into the housing 3 by means of its internal tongues that are not shown (FIG. 4L).

The connection system 11 finally assembled incorporating the angled multicontact connector according to the invention with its conductive cap crimped to the outer sheath 20 of the cable 2 is represented in FIG. 5.

Figure 6:
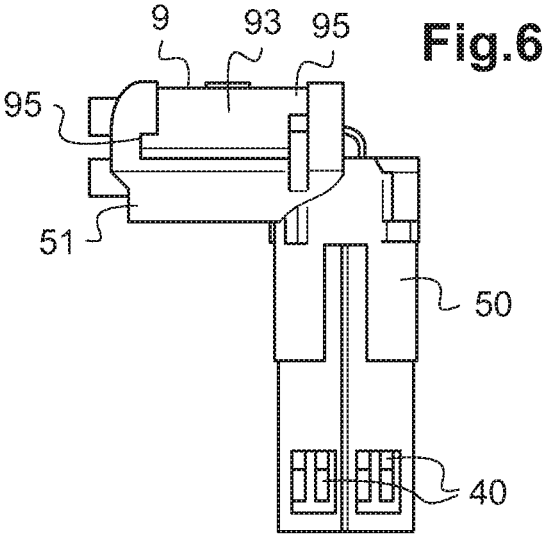
FIG. 6 is a side view showing a variant of the insulating part according to the invention when clipped into the insulator of the angled connector.

There has been represented in FIG. 6 an advantageous variant of the insulating part 9 according to the invention: one or more keys 95 taking the form of excresences at one or more corners of the insulating face 92 make(s) it possible to prevent any incorrect mounting of the insulating part 9 in the angled insulator 5.

Figure 7:
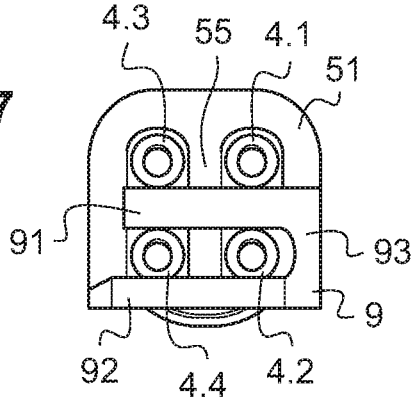
FIG. 7 is a view in cross section showing a variant of the insulating part according to the invention when clipped into the insulator of the angled connector.

There has been represented in FIG. 7 another advantageous variant of the insulating part 9 according to the invention: the insulating face 92 perfectly espouses the peripheral wall of the rear portion 51 of the angled insulator 5 by closing the latter as it were.

The embodiments shown in FIGS. 1 to 7 concern four contacts 4.1 to 4.4. Implementation of the solution of the invention may of course be envisaged for an angled connector with a greater number of contacts.

Figure 8:
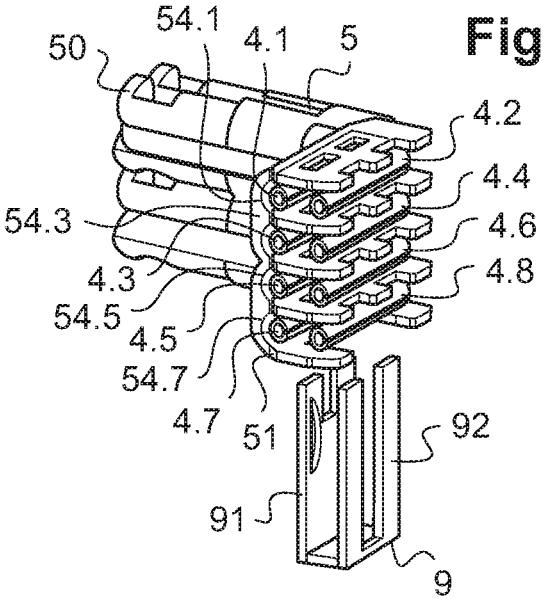
FIGS. 8 to 8B are perspective views of a variant of the invention with eight contacts superposed in two rows of four, respectively in the position with the contacts mounted in the insulator, in the position with the insulating part according to the invention clipped into the insulator, and finally with the contacts mounted in the insulator, retained by the insulating part and crimped to the conductors of the cable.
Figure 8A:
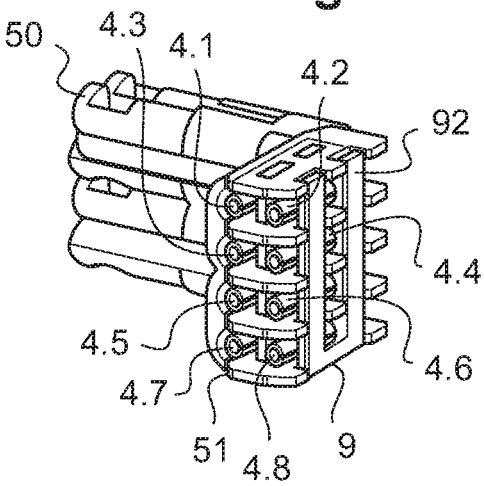
Figure 8B:
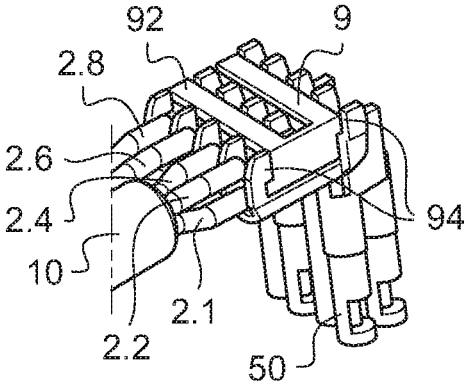

There has been shown in FIGS. 8 to 8B a variant with eight contacts 4.1 to 4.8 including a row of four short connectors 4.1, 4.3, 4.5, 4.7 on which is superposed a row of four long contacts 4.2, 4.4, 4.6, 4.8.

The short contacts 4.1, 4.3, 4.5, 4.7 are therefore received and maintained individually in one of the four parallel grooves 54.1, 54.3, 54.5, 54.7 provided for this purpose in the rear portion 51 of the angled insulator 5.

In this variant shown, the insulating part 9 has the same U-shape as in the embodiments of FIGS. 1 to 7 but the branches 91, 92 are longer in order to insulate the greater number of contacts.

As shown in FIG. 8A, the eight contacts 4.1 to 4.8 are retained in the angled insulator 5 by their insertion in the front portion 50 and locked in the rear portion 51 of the angled insulator 5 by the insulating part 9.

As shown in FIG. 8B, the eight contacts 4.1 to 4.8 are then individually crimped to the insulated conductors 2.1 to 2.8 of the cable.

Of course, the invention is not limited to the embodiments have just been described.

Other variants and improvements may be envisaged without departing from the scope of the invention.

In all the embodiments shown in FIGS. 1 to 8B the contacts 4.1 to 4.8 are divided into two rows superposed one on the other and the insulating part 9 is U-shaped with one branch 91 that serves to insulate a row of short contacts 4.1, 4.3, 45, 4.7 relative to the row of long contacts 4.2, 4.4, 4.6, 4.8 and the other branch 92 serving to insulate the long contacts 4.2, 4.4, 4.6, 4.8 from the conductive cap 8.

In the context of the invention, arranging the contacts in a greater number of superposed rows may very well be envisaged, with the shortest contacts in the bottom row at the bottom of the grooves, the longest contacts in the top row, and those of intermediate length in the intermediate row or rows.

In this embodiment, the insulating part 9 then has a general shape comprising multiple U-shapes back-to-back, in particular a double U-shape and the grooves of the angled insulator 5 are deeper in order to receive a greater number of superposed rows (at least three rows). In this embodiment, the lower branch 91 and the inner branch or branches of the multiple U-shape still make it possible to insulate the superposed contacts from one another and the outer branch 92 makes it possible to insulate the rows of the longest contacts from the conductive cap 8.

Figure 9:
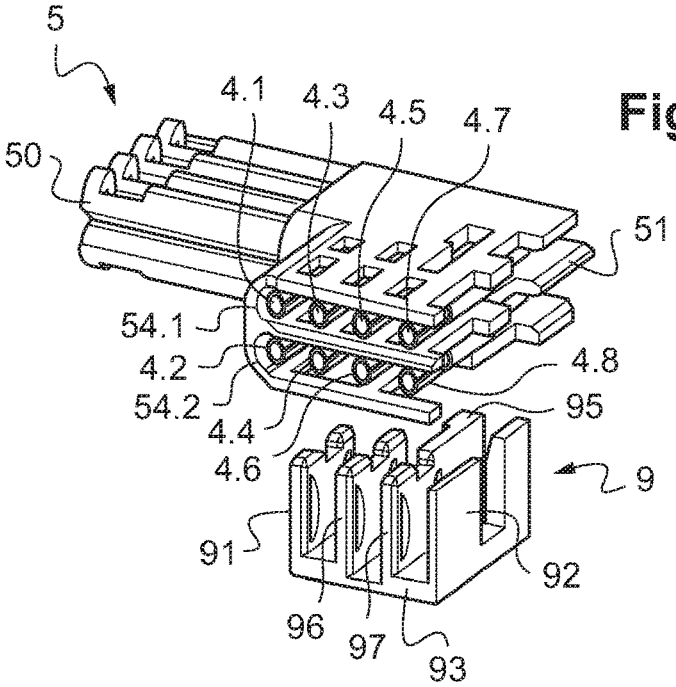
FIGS. 9 to 9B are perspective views of a variant of the invention with eight contacts superposed in four rows of two, respectively in the position with the contacts mounted in the insulator, in the position with the insulating part according to the invention clipped into the insulator, and finally with the contacts mounted in the insulator, retained by the insulating part and crimped to the conductors of the cable.
Figure 9A:
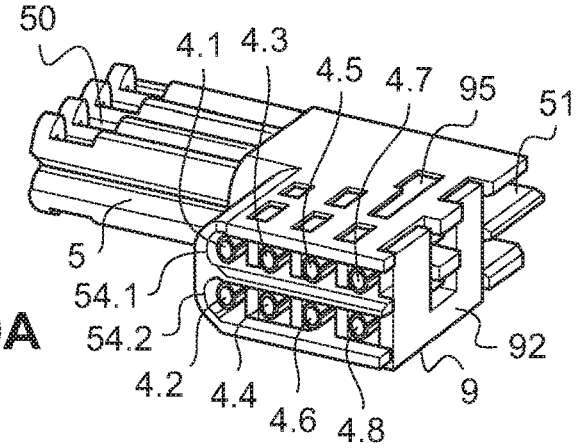
Figure 9B:
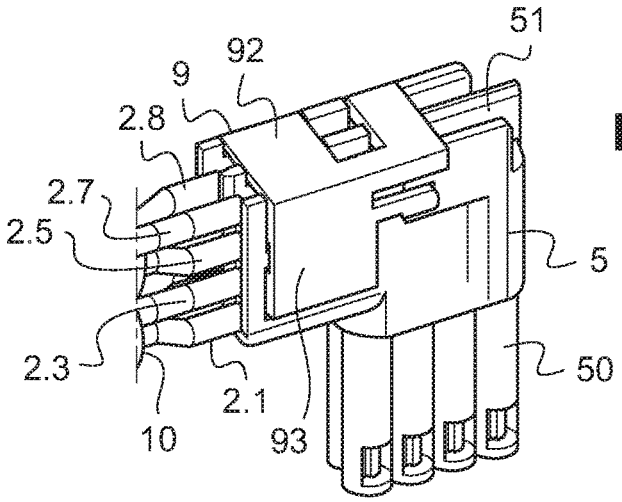

There has been shown in FIGS. 9 to 9B a variant still with eight contacts 4.1 to 4.8 but, in contrast to the variant from FIGS. 8 to 8B, here superposed in four rows of two contacts.

In this variant shown, the row of the two shortest contacts 4.1, 4.2 is received and held individually parallel in one of the two parallel grooves 54.1, 54.2 provided for this purpose in the rear portion 51 of the angled insulator 5.

In this variant shown, the insulating part 9 has a shape comprising three back-to-back U-shapes delimited by four branches 91, 92, 96, 97. In the variants shown already commented on, the outer insulating face 92 in this variant from FIGS. 9 to 9B also perfectly espouses the peripheral wall of the rear portion 51 of the angled insulator 5, closing it, as it were.

One branch 97 of the two branches 96, 97 inside the insulating part 9 includes a key 95 taking the form of an excrescence at one corner of the branch that makes it possible to prevent incorrect mounting of the insulating part 9 of the angled insulator 5.

As shown in FIG. 9A, the eight contacts 4.1 to 4.8 are superposed two-by-two and retained in the angled insulator 5 by their insertion in the front portion 50 and locked in the rear portion 51 of the angled insulator 5 by the insulating part 9.

As shown in FIG. 9B, the eight contacts 4.1 to 4.8 are then individually crimped to the insulated conductors 2.1 to 2.8 of the cable.

Although in the embodiments shown the contacts 4.1 to 4.8 shown are fixed to the conductors 2.1 to 2.8 of the cable by crimping them, having them soldered to the latter may very well be envisaged.

Also, although in the embodiments shown the contacts 4.1 to 4.8 shown are bent after their partial insertion in the front portion 50 of the angled insulator 5, they may equally well be bent before their partial insertion. This variant may be applied to soldered or crimped contacts.

Moreover, although the insulating part 9 is mounted and clipped in the angled insulator 5, it may equally be mounted in the latter with a force fit.

Furthermore, although the outer insulating face 92 of the insulating part 9 shown is produced with apertures, making it solid may very well be envisaged.

Figure 10:
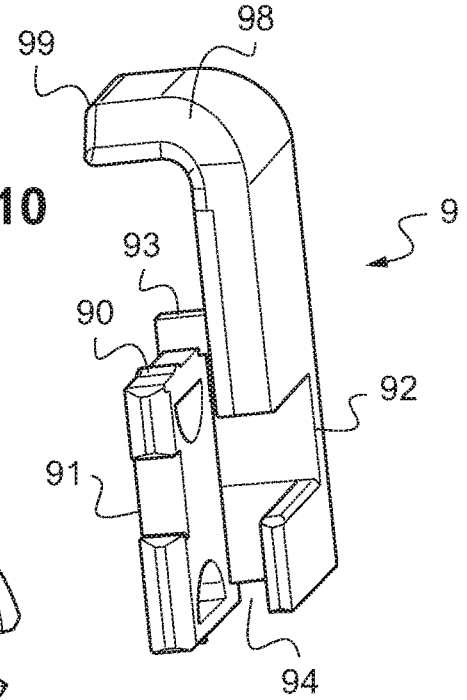
FIG. 10 is a perspective view of an insulating part according to an advantageous embodiment of the invention.

FIG. 10 shows an advantageous embodiment of the insulating part 9. In this embodiment there is an additional wall 98 with substantially the same angled shape as the angled insulator 5 and the angled contacts 4.1, 4.2, 4.3, 4.4.

Figure 11:
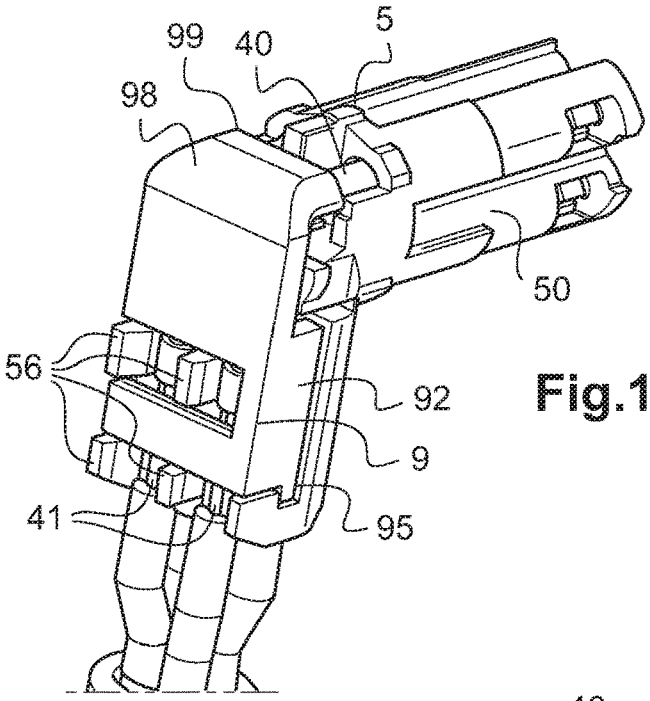
FIG. 11 is a perspective view of an example of a connection system incorporating an angled multicontact connector according to the invention including the insulating part from FIG. 10.
Figure 12:
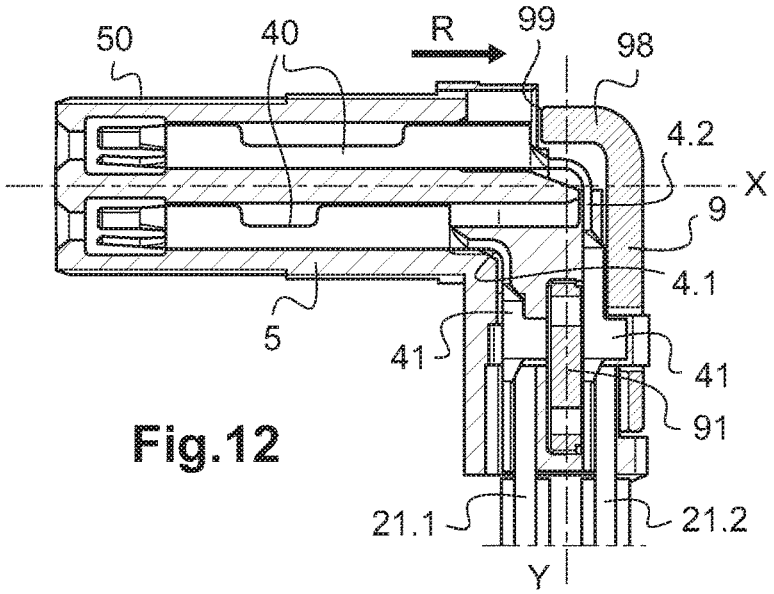
FIG. 12 is a view in longitudinal section of FIG. 11.

As shown in FIGS. 11 and 12, the bend 98 therefore covers the space above the long contacts 4.2, 4.4 nearest the outside of the angled insulator 5 and at least a portion of the front end of this bend 98 is positioned facing the front end 40 of the long contacts 4.2, 4.4 when the insulating part 9 has been clipped into the angled insulator 5.

The front end 99 of the bend 98 therefore forms an abutment that makes it possible to limit the movement in translation of the long contacts 4.2, 4.4 nearest the outside of the angled insulator 5 along the first axis (X). As a result, on connection of the connector with a complementary connector, the rearward movement of the contacts 4.2, 4.4 in the direction of the arrow R in FIG. 12 is small and therefore any significant deformation of the angled zone of the contacts 4.2, 4.4 is prevented.

The invention claimed is:

1. An angled multicontact connector for a cable including a plurality of insulated conductors, the angled multicontact connector comprising:

at least two angled contacts each having a rear end and a front end, and each being adapted to be fixed by the rear end to an end of a conductor of the cable, an insulative angled body made of an insulative material, the insulative angled body comprising:

a front portion extending along a first axis of the insulative angled body including at least two through-openings, each through-opening being adapted to accommodate the front end of an angled contact, the front portion including at least one wall between through-openings adapted to separate the angled contacts from one another, and a rear portion extending along a second axis of the insulative angled body the rear portion forming a bend with the front portion of the insulative angled body;

a conductive angled body made of a conductive material, the conductive angled body comprising:

a front portion extending along a first axis of the conductive angled body and including a through-opening adapted to accommodate the front portion of the insulative angled body, and a rear portion extending along a second axis of the conductive angled body and including a groove adapted to receive the rear portion of the insulative angled body;

a conductive material cap of complementary shape to the rear portion of the conductive angled body adapted to be fixed to the cable and to close the conductive angled body around the at least two angled contacts;

wherein the rear portion of the insulative angled body includes at least one groove open toward the outside of the insulative angled body, each of the at least one groove being adapted to receive at least in part the rear end of one of the at least two angled contacts; and an insulative material part adapted to be removably fixed to the insulative angled body, the insulative material part including walls adapted to retain the rear end of each of the at least two angled contacts not received in the at least one groove in the insulative angled body, the walls being further adapted to separate each rear end from a rear end of any other angled contact received or not in the at least one groove in the insulative angled body, and from the conductive cap when the conductive cap is in a position closing the conductive angled body.

2. The angled multicontact connector according to claim 1, wherein the rear portion of the insulative angled body is configured so that the insulative material part is inserted in the rear portion in a direction transverse to the second axis (Y) of the insulative angled body, the insulative material part including means for clipping onto the rear portion once the insulative material part has been inserted.

3. The angled multicontact connector according to claim 1, wherein the insulative material part is generally substantially U-shaped, having two branches and a bottom, one branch of the U-shape being adapted to separate the rear end of each angled contact received in at least one groove in the rear portion of the insulative angled body and the rear end of superposed angled contact or contacts not received in the at least one groove, the other branch of the U-shape being adapted to separate the conductive cap and the rear end of the at least two angled contacts not received in the at least one groove while the bottom of the U-shape defines a mounting clearance of the rear end of the at least two angled contact not received in the at least one groove.

4. The angled multicontact connector according to claim 1, wherein the insulative material part has a substantial shape of multiple U-shapes, having two outer branches, one or multiple inner branches, and a bottom, one of the outer branches and the one or multiple inner branches of the multiple U-shapes being adapted to separate the rear end of the at least two angled contacts received in at least one groove in the rear portion of the insulative angled body and the rear end of at least one superposed angled contact not received in the at least one groove, the other outer branch of the multiple U shapes being adapted to separate the conductive cap and the rear end of at least two angled contacts not received in the at least one groove, while the bottom of the multiple U-shapes defines a mounting clearance of the rear end of at least two angled contacts not received in the groove.

5. The angled multicontact connector according to claim 1, wherein the insulative material part includes at least one key to prevent improper mounting.

6. The angled multicontact connector according to claim 1, wherein the insulative material part further includes an angled wall with substantially the same angled shape as the insulative angled body and the at least two angled contacts, the angled wall of the insulative material part being adapted to cover a space above the at least two angled contacts nearest the outside of the insulative angled body to form an abutment in respect to a movement in translation of the at least two angled contacts in a direction along the first axis of the insulative angled body.

7. The angled multicontact connector according to claim 1, further comprising a conductive element which is closed and adapted to be fixed to an inside of the front portion of the conductive angled body so as to form an earth contact.

8. The angled multicontact connector according to claim 1, wherein the angled multicontact connector includes at least four angled contacts, the front portion of the insulative angled body including at least one wall for separating two of the at least four angled contacts accommodated in the through-openings closest to an inner side of the bend of the insulative angled body from the at least two angled contacts which are accommodated in the through-openings closest to an outer side of the bend of the insulative angled body or which are accommodated in through-openings of the front portion which are located between the through-openings closest to the inner side of the bend of the insulative angled body and the through-openings closest to an outer side of the bend of the insulative angled body, the front portion and/or the rear portion of the insulative angled body including at least one wall for separating the at least two angled contacts accommodated in the through-openings of the front portion on a first side of the first axis of the insulative angled body from the angled contacts accommodated in the through-openings on an other side of the first axis or accommodated in intermediate through-openings located between the through-opening on the first side and the through-openings on the other side.

9. A connection system comprising:

the angled multicontact connector according to claim 1;

an electrically insulative housing adapted to be mounted around the front portion of the insulative angled body.

10. A method of assembling a part of an angled multicontact connector, the method comprising:

a/ procuring a cable including a plurality of insulated conductors;

b/ procuring a part of an angled multicontact connector adapted to be mounted on the cable, the part of the angled multicontact connector including:

at least two angled contacts each having a front end and a rear end, an insulative angled body made of an insulative material including:

a front portion extending along a first axis of the insulative angled body including at least two through-openings, each through-opening being adapted to accommodate the front end of an angled contact, the front portion including at least one wall between through-openings adapted to separate the angled contacts from one another;

a rear portion extending along a second axis of the insulative angled body and including at least one groove open toward the outside of the insulative angled body, the at least one groove being adapted to receive at least in part the rear end of an angled contact;

c/ fixing the conductors of the cable to the angled contacts of the angled multicontact connector;

d/ inserting parallel to the first axis of the insulative angled body the front ends of the angled contacts in the through-openings of the front portion of the insulative angled body;

e/ bending the angled contacts;

f/ accommodating the rear ends of the angled contacts situated on the inside of the bend in the grooves in the rear portion of the insulative angled body;

g/ clipping an insulative material part in the rear portion of the insulative angled body, the insulative material part including walls adapted to retain the rear end of each angled contact not received in the at least one groove in the rear portion of the insulative angled body and to separate each rear end from a rear end of any other angled contact received or not in the at least one groove in the rear part of the insulative angled body, and from the outside of the insulative angled body;

the step c/ being carried out either before the step d/ or after the step f/;

the step e/ being carried out either before the step d/ or after the step d/.

11. The method according to claim 10, the step c/ consisting in crimping or soldering the at least two angled contacts to the conductors of the cable.

12. The method according to claim 10, further comprising procuring a conductive angled body made of a conductive material and including:

a front portion extending along a first axis of the conductive angled body and including a through-opening adapted to accommodate the front portion of the insulative angled body;

a rear portion extending along a second axis of the conductive angled body and including a groove adapted to receive the rear portion of the insulative angled body;

wherein a cap is crimped onto the rear portion of the conductive angled body.

13. The method according to claim 10, further comprising crimping a cap onto one or both of a shielding braid and an inner and/or outer insulative sheath of the cable.

* * * * *